United States Patent [19]

Kallio et al.

[11] 4,444,529

[45] Apr. 24, 1984

[54] BOLT-LIKE FIXING ASSEMBLY FOR REINFORCING ROCK STRUCTURE

[75] Inventors: Tapio Kallio; Tauno Korhonen; Veikko Leiviskä; Jorma Pulkkinen, all of Porvoo; Kalevi Salo, Hamari, all of Finland

[73] Assignee: Neste Oy, Finland

[21] Appl. No.: 370,275

[22] Filed: Apr. 20, 1982

[30] Foreign Application Priority Data

Apr. 22, 1981 [FI] Finland ..... 811252

[51] Int. Cl.[3] ..... E21D 21/00

[52] U.S. Cl. ..... 405/259; 411/75; 411/76

[58] Field of Search ..... 405/259, 260; 411/76, 411/77, 75, 78, 79, 80

[56] References Cited

U.S. PATENT DOCUMENTS

| | | | |
|---|---|---|---|
| 2,650,476 | 9/1953 | Crockett | 405/259 X |
| 2,651,962 | 9/1953 | Hammond | 405/259 X |
| 2,690,693 | 10/1954 | Campbell | 405/259 X |
| 3,373,649 | 3/1968 | Taylor | 411/76 |
| 3,738,071 | 6/1973 | Finsterwalder | 405/260 X |
| 3,797,254 | 3/1974 | Askey et al. | 405/259 |
| 4,092,814 | 6/1978 | Kern | 405/260 X |
| 4,369,003 | 1/1983 | Brandstetter | 405/260 |

*Primary Examiner*—Dennis L. Taylor

*Attorney, Agent, or Firm*—Steinberg & Raskin

[57] ABSTRACT

A bolt-like fixing assembly for use in improving the strength and/or stability characteristics of rock structure, such as for reinforcing rocks, includes an elongate structure one end of which is adapted to be fixed within a bore formed in a rock and a device for fixing the other end of the elongate structure to the surface of the rock. According to aspects of the invention, the elongate structure is constituted of at least two rod-like members and a fixing device of the elongate structure is constituted by a wedge-shaped member and a bearing plate, such as a washer. The elongate structure is preferably constituted of three rod-like members, each of which preferably is constituted of a bulb steel rod.

8 Claims, 7 Drawing Figures

BOLT-LIKE FIXING ASSEMBLY FOR REINFORCING ROCK STRUCTURE

BACKGROUND OF THE INVENTION

The present invention relates generally to apparatus for reinforcing rock structure and, more particularly, relates to bolt-like fixing assemblies including an elongate structure one end of which is fixed within a bore formed in a rock, and means for fixing the other end of the elongate structure to the rock surface.

Rock bolting will be understood by those skilled in the art as constituting a measure undertaken to increase the strength of rock and/or to insure the stability of a rock structure. Rock bolting entails the use of rock bolts which will be understood as including a rod adapted to be situated within a bore drilled in the rock and whose purpose is to fix boulders or large rocks to intact rock and/or to prevent the separation of adjacent boulders. Thus, generally, rock bolting is used to achieve reinforcement of rock structure.

The technique of rock bolting is generally performed as follows. So-called bulb steel rods having a diameter of, for example, 25 mm are used as the rock bolts. A thread is machined on one end of the bulb steel rod whereupon the rock bolt is inserted into a bore previously drilled in the rock whereupon a washer is tightened against the surface of the rock by a threaded nut thereby preventing the boulder from falling. The other end of the rock bolt is fixed within the bore of the rock either by grouting or, in the case of an active rock bolt, by means of a wedge. One example wherein rock bolting is used is in the construction of a conventional rock cistern for crude petroleum storage which will require about 20,000 rock bolts.

The conventional arrangement for strengthening rock structure described above, however, has several drawbacks. For example, the rock bolts are exceedingly expensive and, secondly, the use of rock bolts having various lengths is inconvenient. Thirdly, the installation or mounting of the rocks involves several time consuming steps and, fourthly, the machined thread of the rock bolt will inherently reduce the strength of the fixation. Moreover, in the case of a passive rock bolt, the possibility of after-tightening is not required.

SUMMARY OF THE INVENTION

Accordingly, one object of the present invention is to provide a new and improved bolt-like fixing assembly for use in reinforcing rock structure.

It is another object of the present invention to provide a new and improved bolt-like fixing assembly for reinforcing rocks which does not require a threaded rock bolt and which at the same time has improved strength relative to conventional rock bolts.

Still another object of the present invention is to provide a new and improved bolt-like fixing assembly for use in reinforcing rock structure which is easily installed.

A further object of the present invention is to provide a new and improved bolt-like fixing assembly which can be modified on site to any desired dimension.

Yet another object of the present invention is to provide a new and improved bolt-like fixing assembly whose installation is possible utilizing mechanical means.

Briefly, in accordance with the present invention, these and other objects are attained by providing a bolt-like fixing assembly for use in reinforcing rock structure including an elongate structure one of whose ends is adapted to be fixed within a bore formed within a rock and means for fixing the other of the ends of the elongate structure to the surface of the rock and wherein the elongate structure is constituted by at least two substantially adjacent rod-like elements and wherein the fixing means by which the other of the ends of the elongate structure is fixed to the surface of the rock is constituted by wedge-shaped means and a bearing member, such as a washer.

In preferred embodiments of the invention, the elongate structure is constituted by three rod-like members and the latter may be constituted by bulb steel rods. The washer-like member has an opening formed therein which in alternate embodiments has a substantially triangular or circular shape. The wedge-shaped means of the fixing means may in certain embodiments have a forward portion adjacent the pointed end of the wedge-shaped means which has a taper which is substantially greater than that of the rearward portion of the wedge member. Moreover, the wedge-shaped means may have a transverse cross-section in the shape of an equilateral triangle in certain embodiments.

By the particular construction of the bolt-like fixing assembly according to the present invention, remarkable advantages are obtained. More particularly, since the use of screw threads is entirely eliminated, the strength of the bolt-like fixing assembly is significantly increased. It is possible to manufacture the assembly utilizing high grade steels which are not normally produced economically other than in smaller diameters. Due to the higher strength of the bolt-like fixing assembly of the present invention, a wider spacing between bolting positions than is conventional may be used thereby achieving considerable savings. The bolt-like fixing assembly of the present invention will have a greater outer surface area since it is constituted by a plurality of rod-shaped members so that the grouting adhesion area will be correspondingly larger. Moreover, it is possible to introduce the grouting mix into the bore drilled in the rock either before or after installing the bolt-like fixing assembly since the additional mix is easily driven out from the bore. Importantly, the bolt-like fixing assembly according to the present invention can be modified to desired dimensions from stock material on site. This is a significant advantage since situations are often encountered in which poor rock quality requires considerably deeper bores to be drilled in the rock than was originally calculated which naturally implies the use of longer bolt-like structures. The bolt-like fixing assembly of the present invention is also capable of being installed by mechanical or machine means. Furthermore, the present invention facilitates installation in that the rod members may be inserted one at a time into the bore thereby reducing the amount of manual labor required.

DESCRIPTION OF THE DRAWINGS

A more complete appreciation of the present invention and many of the attendant advantages thereof will be readily obtained as the same becomes better understood by reference to the following detailed description when considered in connection with the accompanying drawings in which:

FIG. 5*a* is a side elevation view of a wedge-shaped member forming a part of the bolt-like fixing assembly;

FIG. 5*b* is a rear side elevation view of the wedge-shaped member illustrated in FIG. 5*a;* and FIG. 5*c* is a front elevation view of the wedge-shaped member illustrated in FIG. 5*a*.

DESCRIPTION OF THE PREFERRED EMBODIMENTS

Figure 1:
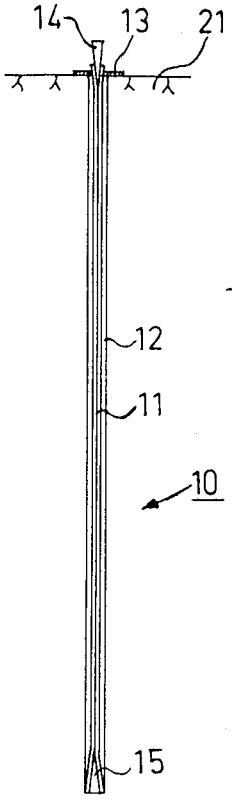
FIG. 1 is a schematic elevation view of a bolt-like fixing assembly according to the present invention in use.
Figure 2:
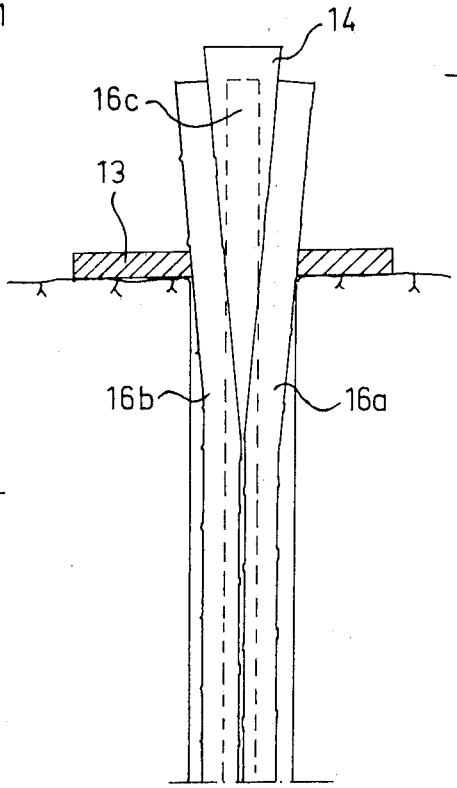
FIG. 2 is a schematic elevation view in partial section illustrating a detail of the bolt-like fixing assembly shown in FIG. 1 on the enlarged scale.

Referring now to the drawings wherein like reference characters designate identical or corresponding parts throughout the several views, and more particularly to FIGS. 1 and 2, a bolt-like fixing assembly in accordance with the invention is generally designated 10 and includes a bolt portion or elongate structure, generally designated 11. The elongate structure 11 is situated in a bore 12 formed in the rock 21 and the inner one of its ends (the lower end as seen in FIG. 1) is fixed in the bore 12 in a conventional manner, such as by grouting or the like. In the illustrated embodiment, the inner end of elongate structure 11 is fixed within the bore 12 drilled in rock 21 utilizing a wedge means 15.

The bolt-like fixing assembly 10 further comprises means for fixing the other end (the upper end as seen in FIG. 1) of the bolt-like fixing assembly to the surface of rock 21.

According to an important aspect of the invention, the elongate structure 11 is constituted of at least two substantially adjacent rod-like elements and in the illustrated embodiment is constituted by three rod-like elements 16*a*, 16*b*, and 16*c*. According to another important aspect of the present invention, the fixing means by which the outer end of the elongate structure 11 is fixed to the surface of the rock 21 is constituted by wedge-shaped means 14 and a bearing member in the form of a washer 13 adapted to be fitted over the outer end of elongate structure 11.

For the rod-like elements 16*a*–16*c*, so-called bulb steel rods have been found advantageous. As seen in FIG. 2, the rod-like members may have narrow raised portions formed on their outer surfaces.

Figure 3:
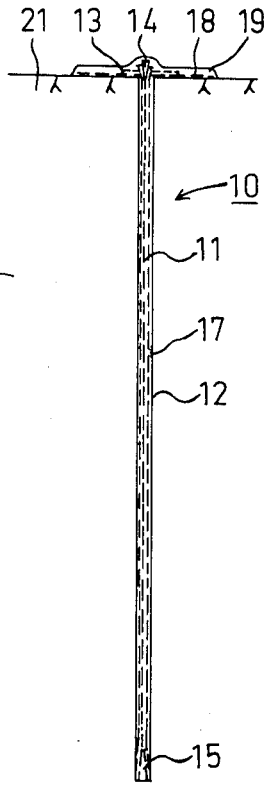
FIG. 3 is a view similar to FIG. 1 illustrating another embodiment of a bolt-like fixing assembly according to the present invention.

In the embodiment illustrated in FIG. 3, the bolt-like fixing assembly 10 includes an elongate structure 11, constituted by three bulb steel rods 16*a*, 16*b* and 16*c*, and fixing means comprising wedge-shaped means 14 and a washer member 13. The elongate structure of the bolt-like fixing assembly is fixed in the bore 12 drilled in the rock 21 at its inner end by wedge means 15. The grouting which surrounds the elongate structure 11 of the bolt-like assembly 10 in the bore 12 is indicated by numeral 17. In this embodiment, the top or outer end of the bolt-like fixing assembly 10 is covered with a layer 19 of sprayed concrete. A steel wire netting 18 is placed over the outer end of the bolt-like assembly 10 prior to depositing the layer 19 of sprayed concrete. It should be noted that the provision of such a sprayed concrete covering layer 19 over the outer end of the bolt-like assembly is often omitted.

Figure 4:
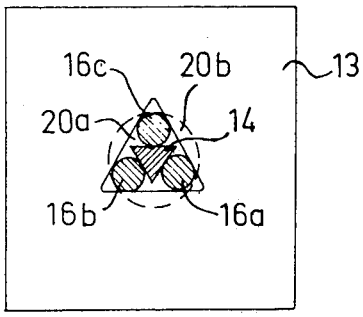
FIG. 4 is a top plan view in partial section of a bolt-like fixing assembly according to the invention and illustrating a washer-like member forming part of the assembly.

Referring now to FIG. 4, one advantageous embodiment of a bearing member forming part of the fixing means and constituting a washer 13 is illustrated. In this embodiment, a substantially triangular opening 20*a* is centrally formed in the washer 13 and this embodiment is especially useful in conjunction with an elongate structure which is constituted by three bulb steel rod members 16*a*, 16*b* and 16*c*. Moreover, the shape of the opening in washer 13 may alternately be in the shape of a circle as indicated by the dotted line 20*b*. However, it is understood that the particular construction of the bolt-like fixing assembly of the present invention enables the shape of the opening in the washer 13 to be especially adpated to conform to the construction of the elongate structure 11 in each particular case. The thickness of washer 13 also may vary depending upon the particular application.

Figure 5:
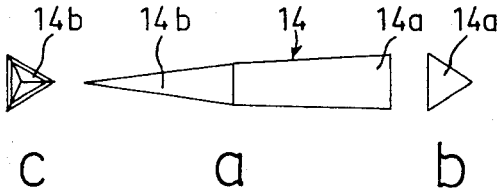

In FIGS. 5*a*–5*c* an advantageous embodiment of the wedge-shaped means 14 forming a part of the bolt-like fixing assembly is shown. The wedge-shaped means comprises a wedge member having a pointed end, a forward portion 14*b* adjacent to the pointed end and a rearward portion distal from the pointed end. According to the illustrated embodiment, the rearward portion 14*a* of the wedge member 14 has a taper which is considerably less than the forward portion 14*b* of the wedge means. Moreover, as seen in FIGS. 5*b* and 5*c*, the wedge member has a transverse cross-section in the shape of substantially an equilateral triangle. This particular embodiment of the wedge-shaped means is particularly suited for use in connection with a bolt-like fixing assembly utilizing three rod-like members, such as 16*a*, 16*b* and 16*c*.

In operation, referring to the illustrated preferred embodiments, the elongate structure 11 is inserted into the bore 12 by inserting the rod-like members 16*a*, 16*b* and 16*c* into the bore 12 drilled in rock 21, whereupon the inner end is fixed and grouting applied. The washer member 13 is then fitted over the top or outer end of the elongate structure 11 with the upper ends of the steel rod-like members passing through the opening 20*a* of washer member 13. The wedge member 14 is then driven between the rods 16 as best seen FIGS. 2 and 4 urging the upper ends of the rod-like members apart and into engagement with respective pairs of converging edges defining the triangular-shaped opening 20*a*. In this manner, the upper or top end of the elongate structure 11 is fixed to the surface of the rock 21. As noted above, a layer 19 of sprayed cement with an enclosed steel wire netting may be applied over the top end of the bolt-like fixing assembly, if desired.

Obviously numerous modifications and variations of the present invention are possible in the light of the above teachings. It is therefore to be understood that within the scope of the claims appended hereto, the invention may be practiced otherwise than as specifically claimed herein.

What is claimed is:

1. In a bolt-like fixing assembly for use in reinforcing rock structure including an elongate structure having a pair of opposite ends, one of said ends being adapted to be fixed within a blind bore formed within a rock, and means for fixing the other of said ends of said elongate structure at the surface of the rock, the improvement comprising:

said elongate structure is constituted by at least two substantially adjacent rod-like elements adapted to be inserted within the bore, said rod-like elements having lengths such that upon initial insertion of said rod-like elements into the bore formed in the rock outer end regions of said rod-like elements protrude beyond the rock surface; and said fixing means are constituted by a bearing member having an opening formed therethrough of a size sufficient to permit passage of said outer end regions of said rod-like elements therethrough and a bearing surface adapted to engage the rock surface with said outer end regions of said rod-like elements passing through said opening, and wedge-shaped means adapted to be driven between said outer end regions of said rod-like elements to urge the same apart and into engagement with edges defining said opening in said bearing member, whereby said other end of said elongate structure is fixed at the rock surface.

2. The combination of claim 1 wherein said elongate structure is constituted by three rod-like members.

3. The combination of claim 1 wherein said rod-like members are constituted by bulb steel rods.

4. The combination of claim 1 wherein said bearing member comprises a washer-like member, said opening formed therein having a substantially triangular shape.

5. The combination of claim 1 wherein said bearing member comprises a washer-like member, said opening formed therein having a substantially circular shape.

6. The combination of claim 1 wherein said wedge-shaped means includes a wedge member having a pointed end wherein a forward portion thereof adjacent to said pointed end has a substantially greater taper than a rearward portion thereof.

7. The combination of claim 1 wherein said wedge-shaped means has a transverse cross-section in the shape of substantially an equilateral triangle.

8. A method for reinforcing rock structure, comprising the steps of:

inserting at least two rod-like elements defining an elongate structure into a bore formed in a rock so that outer ends of the rod-like elements extend out from said bore and fixing the inner end of the elongate structure in said bore;

situating a washer member having an opening formed therethrough such that the upper ends of the rod-like elements pass through the washer member opening and so that the washer member bears against the surface of the rock; and driving a wedge member between the outer ends of the rod-like members to urge them away from each other to engage edges of the washer member defining said opening, whereby the outer end of the elongate structure is fixed at the surface of the rock.

* * * * *